United States Patent [19]

Lawlor

[11] 4,181,311

[45] Jan. 1, 1980

[54] GOLF TEE WITH LINE-OF-FLIGHT INDICATOR

[76] Inventor: Robert E. Lawlor, 17880 Los Alamos St., Fountain Valley, Calif. 92708

[21] Appl. No.: 918,796

[22] Filed: Jun. 26, 1978

[51] Int. Cl.[2] ..... A63B 57/00

[52] U.S. Cl. ..... 273/206

[58] Field of Search ..... 273/33, 201, 202, 206, 273/207, 208, 209, 211, 212, 183 A; D34/5 GT

[56] References Cited

U.S. PATENT DOCUMENTS

| | | | |
|---|---|---|---|
| 1,519,298 | 12/1924 | Mun | 273/206 |
| 1,527,786 | 2/1925 | Cole, Sr. | 273/183 A |
| 1,551,003 | 8/1925 | Bennion | 273/208 |
| 1,554,229 | 9/1925 | Parkhill | 273/208 |
| 1,617,233 | 2/1927 | Byington | 273/204 |
| 1,627,012 | 5/1927 | Copeland | 273/208 |
| 1,638,448 | 8/1927 | Mason | 273/208 |
| 1,670,123 | 5/1928 | Renseen | 273/208 |
| 1,678,944 | 7/1928 | Jacobsen | 273/208 |
| 1,696,136 | 12/1928 | Coburn | 273/208 |
| 1,698,627 | 1/1929 | Glaser | 273/206 |
| 1,936,625 | 11/1933 | Goldman | 273/203 |
| 2,072,688 | 3/1937 | Rose | 273/33 |
| 2,094,320 | 9/1937 | Fidux | 273/206 |
| 2,121,113 | 6/1938 | Barr | 273/33 |
| 2,155,803 | 4/1939 | Rider | 273/204 |
| 2,165,479 | 7/1969 | Hallberg | 273/183 A |
| 2,662,714 | 12/1958 | Smith | 273/183 A |
| 3,347,551 | 10/1967 | Dreyfus | 273/183 A |
| 3,468,545 | 9/1969 | Anderson | 273/183 A |
| 3,883,144 | 5/1975 | Lazow | 273/33 |
| 3,899,179 | 8/1975 | Vlach | 273/208 |

*Primary Examiner*—Richard C. Pinkham
*Assistant Examiner*—T. Brown
*Attorney, Agent, or Firm*—Lyle J. Schlyer

[57] ABSTRACT

An improved golf tee device incorporating a body member constructed of metallic wire surrounded by a protective elastomeric coating and generally describing a uniformly spaced concentric spiral. A golf ball supporting portion extends from one end of the body member and an insertion portion extends from the other end. The body member cooperates with a separate and attached line-of-flight indicating member incorporating a generally triangular planar surface with a bore therethrough adjacent the midpoint of a base of said triangle. The spiral body member passes through the bore and slidably engages the indicating member such that axial rotation of the body member results in translation of the indicating member along the axis of said body member.

5 Claims, 4 Drawing Figures

GOLF TEE WITH LINE-OF-FLIGHT INDICATOR

BACKGROUND OF THE INVENTION

1. Field of the Invention

This invention relates generally to the field of golf tees and, more specifically, to metallic golf tees incorporating line-of-flight indicating means.

2. Description of the Prior Art

With the continuing popularity of golf as a sport, there is growing need for an inexpensive golf tee which will solve the problems inherent in the standard and popular wooden tee and, in addition, provide the golfer with an aid for assuring a proper swing.

The problems inherent in the standard wooden tee are well known to golfers (i.e., broken tees, difficulty in inserting the wooden shafts in firm ground, lack of means for gauging insertion depth, difficulty in locating tees struck by a golf club) and the attempts to provide an improved tee have been numerous. All such attempts have been generally unacceptable, however, due to their inability to fully overcome the attendant problems.

A noteworthy attempted improvement was the metallic tee as described in U.S. Pat. Nos. 1,519,298 and 1,698,627. These inventions eliminated the problems of broken tees and, by means of an attached flag as described in U.S. Pat. No. 2,094,320, aided in locating tees struck by a golf club during a swing. However, the metallic tees resulted in nicks and marks on golf club faces and did not provide sufficient advantages to the golfer to justify the increased costs of the tees.

Golf tees and golf tee attachments are also known which provide visual guides for optimizing player stance by incorporating or attaching a line-of-flight indicating member perpendicular to the vertical shaft of the tee as disclosed in U.S. Pat. No. 3,347,551. Additionally, line-of-flight indicating members which also limit the penetration of the tee into the ground are described in U.S. Pat. Nos. 2,121,113 and 3,883,144. These devices fail, however, to provide a means for adjusting the attachment point of the line-of-flight indicating means to the tee shaft. This feature is essential to providing indicating means which will rest upon the upper surface of the turf of the golf course which, of course, varies in height. Other devices are known which provide minor adjustments and are disclosed in U.S. Pat. Nos. 1,593,480 and 2,165,479, but the former is far to complicated to be economical and both former and latter offer only limited adjustment choices.

SUMMARY OF THE INVENTION

In order to provide an improved golf tee which is unbreakable, easy to find, inserts readily in hard ground, does not mark golf clubs, and provides vertically adjustable line-of-flight indicating means, the applicant proposes a golf tee constructed of a metallic wire body surrounded by a protective elastomeric coating and including a separate, attached line-of-flight indicating member with planar surface perpendicular to the axis of the tee. The metallic body incorporates a straight axial section at the lower end thereof, the remainder of the body being of spiral construction terminating at the upper end thereof in a ball retaining configuration. The indicating member incorporates a bore passing therethrough such that rotation of the spiral body within the bore results in translation of the indicating member along a substantial portion of the axis of the tee.

BRIEF DESCRIPTION OF THE DRAWINGS

The invention will be more fully appreciated from the following detailed description of the preferred embodiment thereof taken in conjunction with the appended drawings wherein.

DETAILED DESCRIPTION OF THE DRAWINGS

Figure 4:
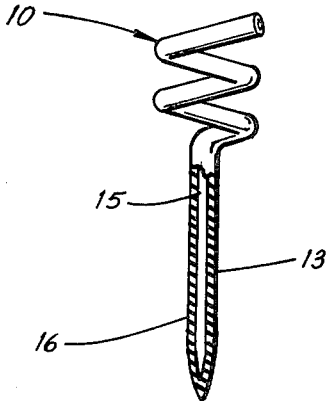
FIG. 4 is an exploded fragmentary cross section of the body of the tee.

As shown in the drawing, the golf tee of this invention includes two parts, a body member 10 and a line-of-flight indicating member 20. The body member 10 is a unitary member preferably constructed of approximately 21 gauge spring steel 15 coated with a surrounding layer of protective, abrasion resistant, elastomeric material 13, as shown in the detail of FIG. 4. This particular combination of materials imparts resilient characteristics to the tee which prevents breakage and, at the same time, interposes a protective layer between the club face and the metal tee to eliminate marking of the club face.

The body member incorporates a straight, axially located, lower section 13 having a pointed end thereof to aid in inserting the body member 10 into the earth E. While the spring steel 15 construction imparts sufficient rigidity to assure ease of insertion into firm ground, the elastomeric coating 13 covers any sharp edges of the terminal point so that the tee may be transported in any cloth or other suitable storage pocket without causing punctures or rips.

The lower section 13 of the body member 10 extends approximately one third of the vertical length thereof and joins the middle section 12 of the body member 10 comprised of a plurality of equal diameter spirals. The spirals of the middle section 12 are axially separated by a distance slightly smaller than the vertical thickness of the line-of-flight indicating member 20. Thus, the middle section 12 of the body member 10, when residing in a bore 23 of the indicating member 20, holds that member in place by clamping action of the spirals. As is obvious in FIG. 1, rotation of the body member 10 with respect to the indicating member 20 results in axial translation of the indicating member 20. In operation, the body member 10 is rotated such that the indicating member 20 resides atop the grass G of the teeing surface when the lower section 13 is fully inserted into the Earth E. The insertion depth is limited by the spirals of the middle section 12. In this manner a golf ball B may be consistently located at a determined level above the earth E while the indicating member 20 may be adjustably located at the most desirable position dependant upon the height of the grass G.

Figure 1:
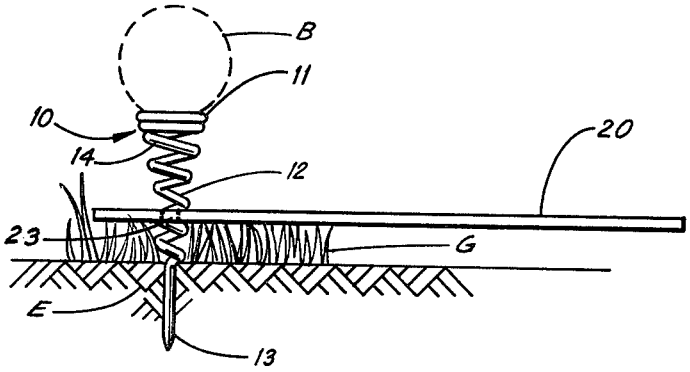
FIG. 1 is a side elevational view showing the golf tee embodying the invention.
Figure 2:
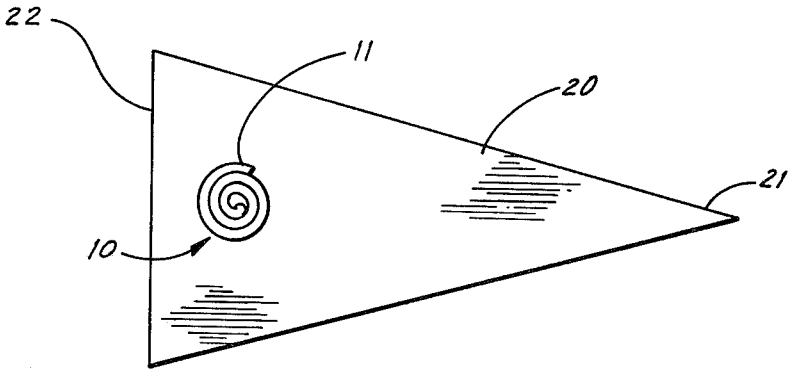
FIG. 2 is a top view thereof.
Figure 3:
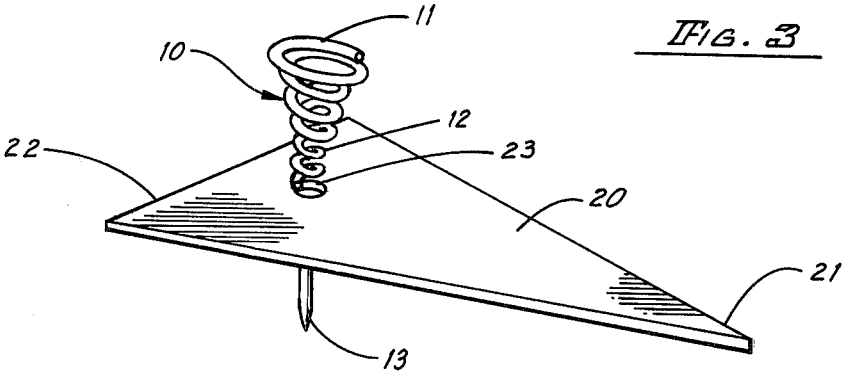
FIG. 3 is a perspective view.

In the upper section 14 of the body member 10, the spring steel core continues to describe a spiral configuration, albeit the spirals thereof increase in diameter with an increase in vertical height and terminate at the uppermost portion of the body member 10 in a ring 11 for receiving the usual golf ball B, shown in phantom lines in FIG. 1.

The line-of-flight indicating member 20 is preferably formed of high impact, molded plastic of a highly visible color. Thus a player adopting the usual stance above the tee will have a tendency to focus on the indicating member 20 rather that the golf ball, which tendency will aid the player in keeping his head down during his swing, a requirement many golfers find difficult.

In addition, the indicating member 20 is preferably of an elongated isosceles triangular shape. The bore 23 through which the body member 10 passes is located adjacent to the midpoint of the base 22 of the triangular shape. Thus, after teeing up a golf ball, a player may rotate the indicating member 20 such that the apex 21 of the triangular shape lies along the intended line-of-flight of the player's drive. The triangular base 22 will then be perpendicular to the line-of-flight, thus aiding the player in positioning the face of the golf club, unshown, and in assuming a proper stance.

In addition to the above mentioned features, the indicating member 20 and attached body member 10 are easily retrievable by the player if they are driven from the tee area during a swing as the indicating member 20 incorporates sufficient planar surface area to be readily observable even in tall grass.

The extensive planar surface area of the indicating member 20 also allows the golf tee to be conveniently transported when not in use in that the indicating member 20 may be readily slipped behind a strap or open pocket of the players golf bag.

It is understood that the embodiment described above is merely an example of the application of the principles of this envention. Additional embodiments may be devised by those skilled in the art without departing from the spirit or scope of the invention.

I claim:

1. A golf tee device comprising:

a. a body member describing a uniformly spaced spiral configuration concentrically surrounding the axis thereof;

b. a golf ball retaining portion extending from one end of said body member;

c. an insertion portion extending from the other end of said body member and incorporating a point on the free end thereof for insertion into the ground, whereby such insertion of the tee into the ground shall be limited by said spiral body member;

d. a line-of-flight indicating member describing a generally triangular upper and lower planar surfaces and incorporating a bore therethrough, said spiral body member passing through said bore to the extent that said lower planar surface is positioned intermediate the ends of said spiral body portion and spaced from the juncture of said spiral body portion and said insertion portion to thereby provide a space between said lower planar surface and the ground into which said insertion portion is inserted and slidably engaging said indicating member such that the axis of said body member is perpendicular to the planar surface of said indicating member;

e. whereby axial rotation of said body member with respect to said indicating member results in translation of said indicating member along the axis of said body member.

2. The device of claim 1 wherein said body member, said golf ball retaining portion and said insertion portion are constructed of metallic wire surrounded by a protective elastomeric coating.

3. The device of claim 1 or claim 2 wherein said golf ball retaining portion describes a spiral conical configuration terminating at the upper end thereof in a ring for supporting a golf ball.

4. The device of claim 1 or 2 wherein said line-of-flight indicating member is further comprised of;

a. a planar surface generally describing an isosceles triangle, b. a bore therethrough adjacent the midpoint of the base of said isosceles triangular planar surface.

5. The device of claim 1 or claim 2 wherein the line-of-flight indicating member is constructed of impact resistant elastomeric material of a high visibility color.

* * * * *